United States Patent [19]

Freeberg

[11] Patent Number: 4,932,659

[45] Date of Patent: Jun. 12, 1990

[54] GOLF PUTTER WITH ALIGNMENT DEVICE

[76] Inventor: Lloyd L. Freeberg, 1953 E. Chapman Ave., Fullerton, Calif. 92631

[21] Appl. No.: 177,134

[22] Filed: Apr. 4, 1988

[51] Int. Cl.[5] ..... A63B 69/36

[52] U.S. Cl. ..... 273/183 D; 273/164; 273/81.4; 273/168; 273/81 B

[58] Field of Search ..... 273/183 D, 168, 163 R, 273/163 A, 164, 81.4, 81 B, 186 A, 193 R, 194 R

[56] References Cited

U.S. PATENT DOCUMENTS 4,327,916 5/1982 Shiratori ..... 273/183 D
4,537,403 8/1985 Farina ..... 273/168 X

*Primary Examiner*—George J. Marlo
*Attorney, Agent, or Firm*—Plante, Strauss, Vanderburgh and Connors

[57] ABSTRACT

There is disclosed a golf putter having a unique shape that improves putting performance. The putter has a more or less conventional head with a flat, ball-striking surface. The metallic shaft of the putter has a rectangular cross section and the front surface, and preferably the rear surface of the shaft, has a highly visible band to indicate to the user whether the putter face is open, closed, or properly aligned. The shaft can be tapered and is rectangular in cross section and terminates with a handle which is also rectangular in cross section. The preferred putter has front surfaces for the handle, shaft and putter face which are parallel. Most preferably, the rear surfaces of the handle, shaft and putter face are also parallel and, most preferably, are also co-planar, thereby permitting reversal of the putter between left and right handed players. In the preferred embodiment, the surfaces of the handle are flush with the mating surfaces of the shaft and both of the front and rear surfaces of the handle have a highly visible band to indicate to the user whether the putter face is open, closed, or properly aligned.

6 Claims, 2 Drawing Sheets

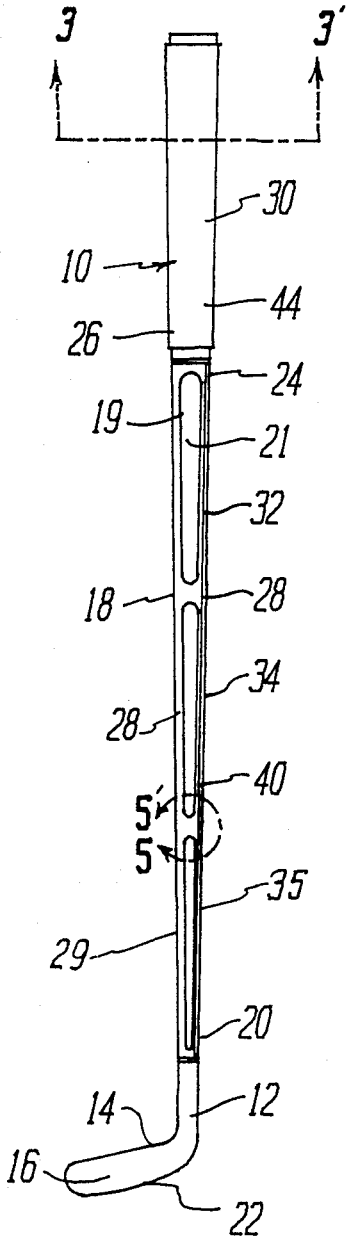
FIGURE 1
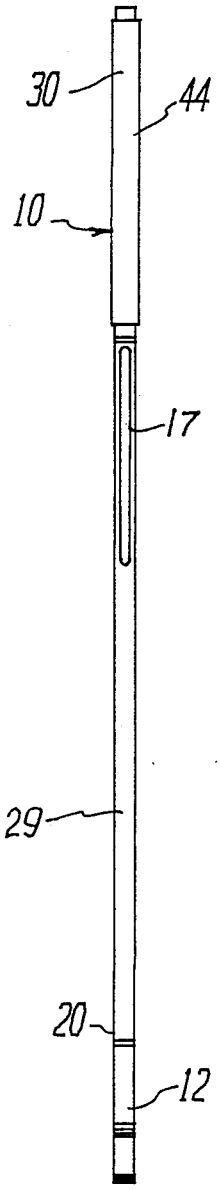
FIGURE 2
FIGURE 3
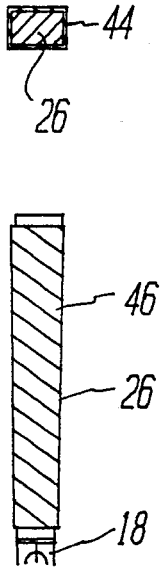
FIGURE 4
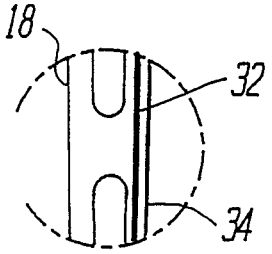
FIGURE 5

FIGURE 6
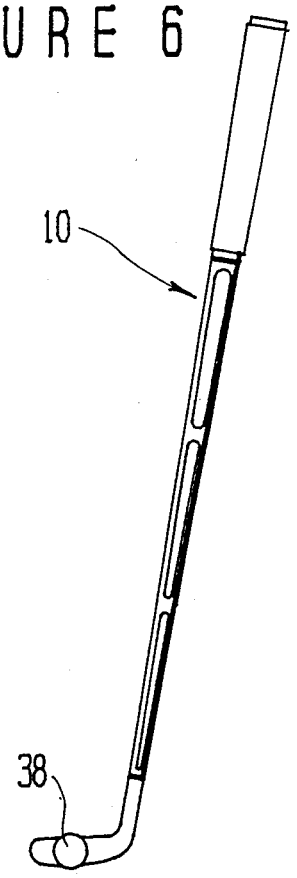
FIGURE 10
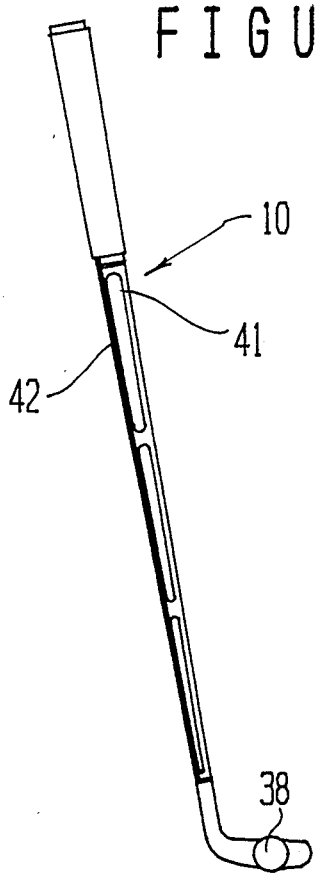
FIGURE 7
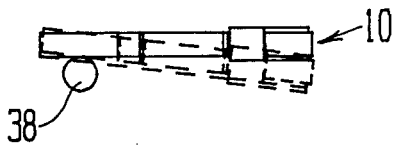
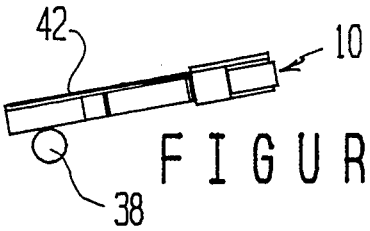
FIGURE 9
FIGURE 8
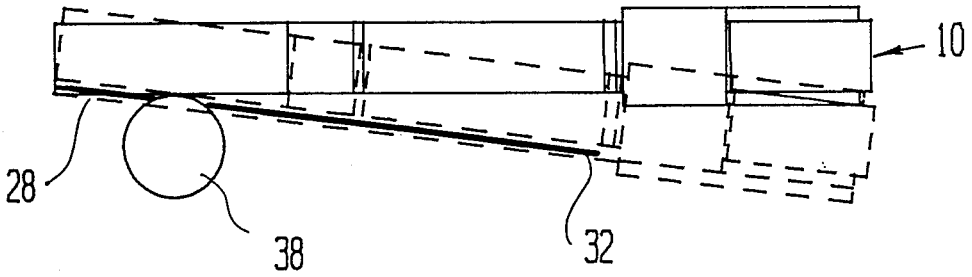

GOLF PUTTER WITH ALIGNMENT DEVICE

BACKGROUND OF THE INVENTION

1. Field of Invention

This invention relates to a golf putter and, in particular, to a golf putter having a design which gives improved performance.

2. Brief Statement of the Prior Art

Many attempts have been made to design clubs and handles for golf which will improve performance. U.S. Pat. No. 4,569,525 shows a training accessory for mounting on the shaft of a golf club to indicate to a player when the face is open or closed, thereby providing informational feedback to the player which will cause the player to correct the rotation of the player's wrists.

U.S. Pat. No. 4,537,403 discloses a putter having a flat, narrow shaft which is intended to minimize obstructions when viewing the club head.

U.S. Pat. No. 4,629,191 discloses a golf club having a pentagonal cross section with multiple sides.

U.S. Pat. No. 3,109,653 discloses a hand grip for a golf putter having an unusual contour to the hand grip portion. Additionally, prior art pertaining to other sports such as hockey discloses sticks which customarily are flat and planar such as shown in U.S. Pat. No. 2,957,208.

BRIEF STATEMENT OF THE INVENTION

This invention comprises a golf putter having a unique shape that improves putting performance. The putter has a more or less conventional head with a flat, ball-striking surface and a shaft having a rectangular cross section. The front and rear surfaces of the shaft have a highly visible band to indicate to the user when the putter face is open, closed, or properly aligned. Preferably the shaft is tapered, with its narrowest end adjacent the putter head and its widest portion at the handle. The shaft is rectangular in cross section and terminates with a handle which is also rectangular in cross section. In the preferred embodiment, the front surfaces of the handle, shaft and putter face are parallel, and most preferably, are co-planar. Preferably the reverse sides are parallel, and most preferably are also coplanar, thereby permitting reversal of the putter between left and right handed players. In the preferred embodiment, the surfaces of the handle are flush with the mating surfaces of the shaft, however, the handle can receive a covering to improve its surface for gripping. The shaft and handle can be formed a single, unitary member, preferably by molding operations, and can be formed of metal or fiber reinforced plastic.

BRIEF DESCRIPTION OF THE DRAWINGS

The invention will be described with reference to the FIGURES of which:

FIG. 1 is a front elevational view of the putter of the invention;

FIG. 2 is a side elevational view of the putter;

FIG. 3 is a view along lines 3–3' of FIG. 1; illustrating the hand grip surface;

FIG. 4 illustrates an alternative hand grip surface;

FIG. 5 is an enlarged view of the area within line 5–5' of FIG. 1;

FIG. 6 is a view of the putter of the invention aligned with a golf ball;

FIG. 7 is a top view of the putter and ball shown in FIG. 6;.

FIG. 8 is an enlargement of FIG. 7;

FIG. 9 is a top view of the putter and ball of FIG. 6 with the putter face improperly open; and FIG. 10 is a view of the putter aligned with a golf ball for a player opposite-handed from the alignment of FIG. 6.

DESCRIPTION OF PREFERRED EMBODIMENT

Referring now to FIG. 1, the putter 10 of this invention is illustrated in elevational view. The putter 10 includes a head 12 of more or less conventional construction and the head 12 has a rectangular shaped body 14 having a ball-striking face 16. The head 14 is solid and, in some applications, one or more weights (not shown) can be added along the base and at the "sweet spot" of the putter head 12 to improve its performance.

The head is fixedly secured to the end of a shaft 18 which is rectangular in cross section. The shaft can have one or more slots 19 along its length, and these slots can extend entirely through the shaft, to reduce its weight. Preferably, a thin web 21 is provided along the midline of the shaft to reduce the tendency of the shaft to resonant or vibrate when the putter strikes a ball.

The shaft 18 is preferably tapered, with its narrowest end 20 adjacent the putter head 12, terminating in a flush attachment to the ball-striking surface 22 of the head 12. In the preferred embodiment, the shaft 18 is molded and the club head 12 is integral therewith. The widest end 24 of the tapered shaft 18 is adjacent the handle 26. The forward face 28 of the shaft 18 is parallel to the forward face 30 of the rectangular handle 26 and, preferably, these surfaces are coplanar.

The forward face 28 of the shaft 18 has a visible band 32 which extends coextensively its length and which is of a highly visible material. This band can be best seen in FIG. 5. The band can be provided by masking or painting a stripe along at least the lower edge 34 of the forward face 28. In some applications, the entire forward face of the shaft 18 can be covered with the highly visible band. Alternatively, a colorful, adhesively backed tape can be laid along the forward, lower edge 34 of the forward face 28 of the shaft 18.

Preferably a shallow groove 17 is provided on the rear surface 40 of handle 18; see FIG. 2. This groove provides a surface for placement of an identifying decal.

Referring now to FIGS. 6 and 7, the putter 10 is shown in alignment with a ball 38. The correct alignment is shown in solid lines in FIG. 7, and in an incorrect, closed alignment in phantom lines. As more evident in the enlarged view of FIG. 8, the band 32 provides a visible indication to the player of misalignment of the putter shaft face 28 when the ball is addressed and also during the stroke of the club. When the ball 38 is correctly addressed in the manner illustrated in the solid lines of FIG. 8, the band 32 is invisible to the player. If the band is visible to the player and the club is in a position as illustrated in the phantom lines of FIG. 8, then the player will recognize that the club face is open and the ball is improperly addressed.

The opposite surface 41 of the shaft 18 also has a similar visible band 42; see FIG. 10. As shown in FIG. 9, when the club head 12 is closed to the ball 38, the rear band 42 will become visible to the player, again indicating an improper addressing of the ball, and requiring correction of the player's wrist and hands.

Referring again to FIG. 1, the handle 26 can be provided with a improved surface for gripping, such as the flexible and elastic cover 44 illustrated in FIGS. 1 and 3. Alternatively, the handle surfaces can be wrapped or covered with a suitable resilient tape 46 formed of plastic or rubber which is adhesively bonded to the handle in a suitable wrapping such as the spiral wrap illustrated in FIG. 4.

The most preferred embodiment employs a handle 26 and a connecting shaft 18 which have coplanar forward faces which are also coplanar with the ball striking face 16 of the putter head 12. This is illustrated in FIGS. 1 and 2, in which the top surface 29 and the bottom surface 35 of the shaft are tapered or inclined towards each other along surfaces which are orthogonal to the front face 28 and rear face 40. This taper in the shaft 18 is optional, and can be used to provide a feeling of strength and rigidity to the shaft without conveying a feeling of excess mass and without rendering the putter too cumbersome for continuous play. Since the forward faces 28 and 30 of the shaft and handle, respectively, are co-planar with the ball striking face 16 of the head 12, the highly visible bands 32 and 42 provide a constant indication of the alignment of the head to the ball, and perfect alignment can easily be obtained.

Preferably, the body of the shaft is relieved by the aforementioned slots 19 which extend, from each side, into the shaft. Most preferably, the slots are not entirely open, but are closed with a thin web 21. As previously mentioned, this reduces the bulk of weight of the putter without causing resonance of vibration. The width of the front and rear surface should be at least equal to, and preferably greater than the width of the top surface 29 and the bottom surface 35.

As shown in FIGS. 1 and 2, the handle and shaft are formed as a single molded, integral member in which the surfaces of the handle are co-planar with the surfaces of the shaft, and the shaft extrusion is tapered, all as shown in FIG. 1. The handle will appear to be of slightly greater thickness and width as it is received within the aforementioned resilient covering, thereby slightly increasing its dimensions.

As previously mentioned, the highly visible bands on the forward and rear faces of the shaft provide a visual indication to the player that the club face is improperly open or closed when the ball is addressed, indicating to the player that the player's wrists should be rotated more or a new grip should be taken of the club which will close the face of the club and render the bands invisible to the player.

Preferably, the shaft and handle are of light weight magnesium or aluminum alloys. This construction provides for minimal expense while preserving the integrity of the handle and shaft and insuring that the critical surfaces of these elements are either co-planar or entirely flush thereby providing for maximum accuracy of putting with the club. The visible bands can be provided on the forward and rearward faces of the shaft by any of a variety of means. A preferred material for the bands is colored and reflective mylar tape sufficiently bright or iridescent to ensure that the player's attention will be directed to any misalignment of the putter. Alternatively, and particularly when extruded aluminum and aluminum alloys are used for the shaft, the band can be permanently provided on the shaft by anodized coatings and the like.

The putter has been found to provide a remarkable increase in accuracy when used by weekend golfers and by professionals. Since the putter is symmetrical from side-to-side it can be used by right or left hand players, and a player can freely switch from left to right hand putting without changing the putter. The single continuous plane through the putter face, shaft and handle insures precise alignment with the ball. The player can also easily see whether the face of the putter is open or closed by observing the colored bands on its front and rear surfaces of the shaft, and make a compensating adjustment.

Players readily adapt to the feel and characteristics of the putter and within a short time of practice achieve significant improvements in putting accuracy. The rectangular flat-sided grip minimizes muscle tension, and aids in accuracy as it reduces the tendency for the player to tense up or choke during a stroke. The known principles of physiology indicate that when a player grips a round shaft or grip, the "wrapping" of the hands around such a shaft creates muscle tension in the wrists, arms, and shoulders. This muscle tension, in turn, causes rotation off-line of the putter head both at address, and throughout the stroke. The rectangular shaft described promotes an opposing palms grip which prevents the tendency to rotate the putter head.

The putter meets all of the requirements of the applicable rules of the golfing associations, and is thus entirely acceptable for regulation and tournament play.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A golf putter including:

a. head having a flat ball-striking face;

b. a handle with a hand grip having a rectangular cross section;

c. an entirely metallic shaft extending between said head and handle with a tapered rectangular cross section having a flat, front surface parallel to said ball-striking face with its narrowest end adjacent said head and widest end adjacent said handle; and d. a visible band coextensive the length of said shaft and located along said front surface of said shaft.

2. The golf putter of claim 1 wherein the front and rear of said hand grip includes surfaces which are substantially coplanar with respective surfaces of said shaft.

3. The golf putter of claim 1 wherein the front and rear surfaces of said hand grip of said handle are flush with the respective front and rear surfaces of said shaft.

4. The golf putter of claim 1 wherein the forward facing side of said shaft is coplanar with said flat ball-striking face of said head.

5. The golf putter of claim 1 wherein the front and rear surfaces of said shaft which are parallel to said ball-striking face are greater in width than the surfaces which are normal to said ball-striking face.

6. The golf putter of claim 1 wherein said hand grip is covered with a resilient flexible covering.

* * * * *